US006895718B2

(12) United States Patent
Moffatt

(10) Patent No.: US 6,895,718 B2
(45) Date of Patent: May 24, 2005

(54) CONSTRUCTION UNIT MOUNTING SYSTEM

(76) Inventor: Andrew Mark Moffatt, 2686 St. Moritz Way, Abbotsford (CA), V3G 1C3

( * ) Notice: Subject to any disclaimer, the term of this patent is extended or adjusted under 35 U.S.C. 154(b) by 0 days.

(21) Appl. No.: 10/360,740

(22) Filed: Feb. 10, 2003

(65) Prior Publication Data

US 2004/0154244 A1 Aug. 12, 2004

(51) Int. Cl.[7] ..... E06B 3/00

(52) U.S. Cl. ..... 52/204.55; 204/214; 204/204.599; 204/213; 204/712

(58) Field of Search ..... 52/204.55, 214, 52/204.599, 213, 712

(56) References Cited

U.S. PATENT DOCUMENTS

| | | | | | |
|---|---|---|---|---|---|
| 1,599,985 | A | * | 9/1926 | Carlson | 403/281 |
| 2,075,955 | A | * | 4/1937 | Parsons | 52/204.599 |
| 2,497,515 | A | * | 2/1950 | Pearse | 52/204.599 |
| 2,840,203 | A | * | 6/1958 | Hehr | 52/204.53 |
| 3,189,137 | A | | 6/1965 | Harris | |
| 3,226,781 | A | | 1/1966 | Schnabel | |
| 3,238,679 | A | * | 3/1966 | Capoccia | 52/204.55 |
| 3,276,179 | A | * | 10/1966 | Rallis | 52/506.09 |
| 3,636,672 | A | | 1/1972 | Fink | |
| 4,079,553 | A | | 3/1978 | Kirk, Jr. | |
| 4,274,235 | A | * | 6/1981 | Langenhorst | 52/204.55 |
| 4,473,981 | A | | 10/1984 | Simpson | |
| 4,527,369 | A | * | 7/1985 | Adams | 52/211 |
| 4,986,044 | A | | 1/1991 | Funari | |
| 5,692,350 | A | | 12/1997 | Murphy, Jr. | |
| 5,722,207 | A | * | 3/1998 | Anderson et al. | 52/204.55 |
| 5,771,644 | A | | 6/1998 | Kidd | |
| 6,216,402 | B1 | | 4/2001 | Van de Laar | |
| 6,253,496 | B1 | * | 7/2001 | Gilchrist | 52/12 |
| 6,293,061 | B1 | | 9/2001 | Horak, Jr. | |
| 6,357,200 | B1 | | 3/2002 | Vanderpan | |
| 6,361,193 | B1 | | 3/2002 | Gabrius et al. | |

* cited by examiner

*Primary Examiner*—Laune K. Cranmer
(74) *Attorney, Agent, or Firm*—Oyen Wiggs Green & Mutala

(57) ABSTRACT

A system for mounting a prefabricated construction unit in an aperture in a building structure comprises a plurality of clips. The clips have exterior ends adapted to be affixed to a frame of the construction unit and interior ends adapted to be affixed to the building structure. The exterior ends may be bent to provide deep grooves which receive a flange of the construction unit. The clips permit a construction unit to be installed without the need for a worker to insert fasteners through the flange from outside the building structure.

37 Claims, 3 Drawing Sheets

CONSTRUCTION UNIT MOUNTING SYSTEM

TECHNICAL FIELD

The invention relates to mounting prefabricated construction units in apertures in building envelopes. The invention has particular application to a system for mounting windows in apertures in a building envelope.

BACKGROUND

Today most windows are provided in the form of a unit which includes one or more glass panes mounted in a frame. The glass panes typically comprise sealed double- or triple-glazed panels. The frame is typically made of vinyl or another plastic material which does not conduct heat well although some aluminum-framed window units are still sold. The frame of each window unit typically includes a broad flange which projects in a lateral direction and extends around the periphery of the window unit. Other types of prefabricated construction units such as doors, vents and sunlights may have similar flanges.

A typical wood frame building has a frame of wooden members which includes apertures for prefabricated construction units such as windows, doors, vents, sunlights and the like. An appropriately-sized construction unit is received in each of the apertures with the flange overlapping with and abutting the outside of the building frame. The construction units are typically secured in place by placing a few screws or nails through the flange into the building frame on each side of the construction units.

One disadvantage of the way that construction units are currently installed is that a person must be outside of the building to install the construction units. This is especially problematic for window units, since window apertures may be located well above ground level. Windows in such locations are often installed by a person standing on a ladder. This can be dangerous, especially if the weather is windy or during winter conditions.

Another disadvantage of the way that construction units are currently installed is that many buildings have a waterproofing membrane applied to their exterior. Puncturing the membrane with screws or nails reduces the effectiveness of the membrane.

There is a need for more efficient ways to install construction units.

SUMMARY OF THE INVENTION

This invention provides prefabricated construction units with tabs which can be used to affix the construction units in place in apertures in a building wall from inside a building. One aspect of the invention provides a clip for use in affixing a construction unit to a building structure. The clip comprises a thin tab having a transverse groove at an exterior end thereof for receiving a flange of a frame of the construction unit and at least one attachment point at an interior end thereof. The at least one attachment point may comprise, for example, one or more of an aperture and a projection projecting substantially perpendicularly to the tab. The clip can be affixed to a frame by inserting a flange of the frame into the groove. The attachment point can be used to affix the clip to a building structure.

Another aspect of the invention provides a clip for affixing a construction unit to a building structure. The clip comprises an exterior end and an interior end. The exterior end of the clip has means for affixing the clip to a frame of a construction unit. The interior end of the clip comprises means for affixing the interior end of the clip to a building structure. Various means for performing these functions are described below.

A still further embodiment of the invention provides a construction unit comprising a frame; a flange projecting laterally from the frame around a periphery of the frame; and, a plurality of tabs projecting from the frame in an interior direction. Each of the tabs is attached to the frame at an exterior end thereof and comprises at least one attachment point at an interior end thereof. The at least one attachment point comprises one or more of an aperture and a projection projecting substantially perpendicularly to the tab.

Yet another aspect of the invention provides methods for installing a construction unit in an aperture in a wall of a building structure. One such method comprises affixing a plurality of tabs to a frame of a construction unit with the tabs projecting interiorly from the frame; placing the construction unit into the aperture; and, affixing an interior end of the tabs to the building structure.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
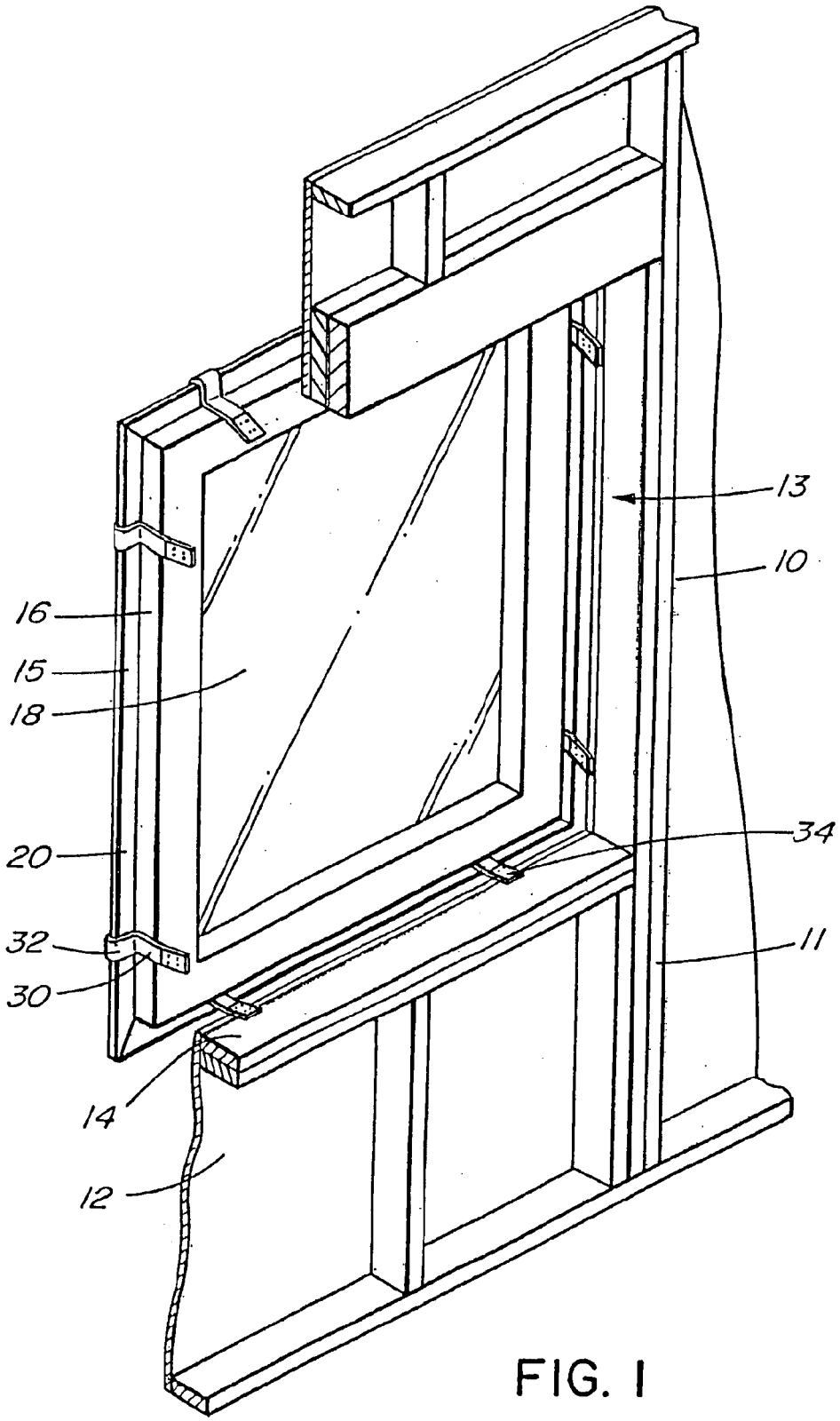
FIG. 1 is a partially cut-away isometric view of a window being installed in a building structure with the use of mounting clips according to the invention.

FIG. 1 shows a portion of the frame 10 of a typical wood-framed structure. Frame 10 comprises wooden studs 11 covered on the exterior by sheathing 12. Frame 10 includes an aperture 13 surrounded by wooden framing members 14 for receiving a window unit 15. Window unit 15 includes a window frame 16, which may be made from any suitable material, and a glass panel 18.

Window unit 15 is illustrated as being four-sided. The invention may also be used with construction units having other shapes such as triangular, round, semi-circular, polygonal etc.

Window frame 16 includes a flange 20 which projects in a lateral direction around the periphery of window frame 16. Aperture 13 is smaller than the outer dimension of flange 20 and is dimensioned to receive window frame 16 while flange 20 bears against the exterior surface of sheathing 12.

This invention provides clips 30. Each clip 30 has an exterior end 32 adapted to engage window frame 16 and an interior end 34 adapted to be fastened to building frame 10 from the inside of building frame 10. Clips 30 are used by affixing a number of clips 30 to each side of window frame 16. In the example shown in FIG. 1 two clips 30 are affixed to each side of window frame 16. For larger window units three or more clips 30 might be affixed to each side of window frame 16. In most cases two or more clips 30 will be affixed to each side of window frame 16.

Figure 2:
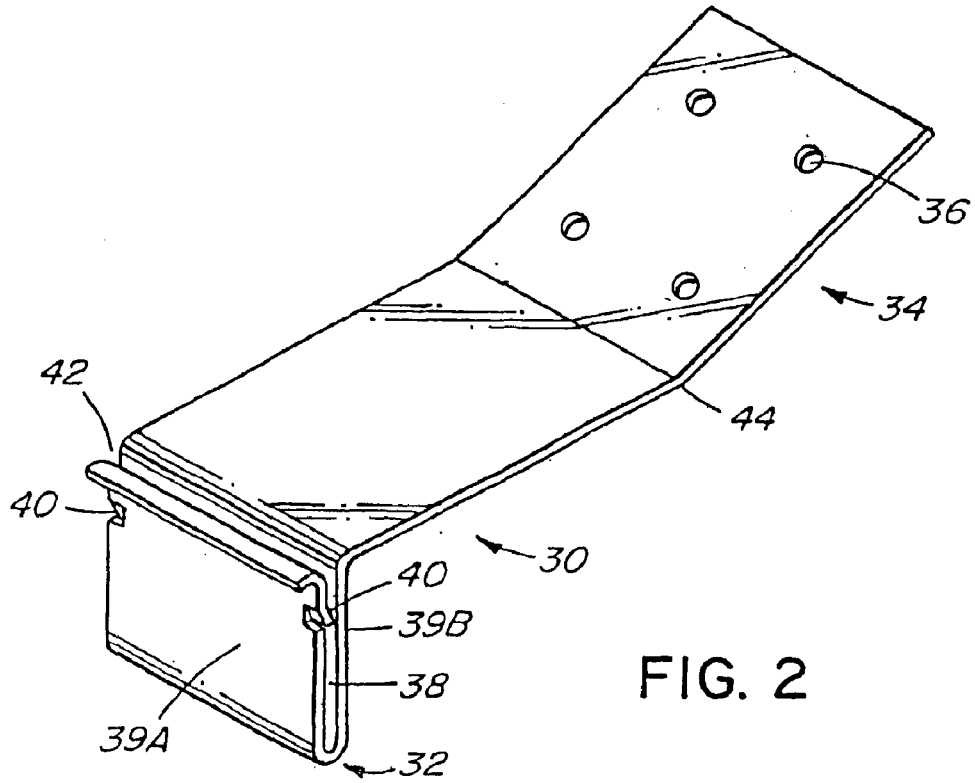
FIG. 2 is an isometric view of a window mounting clip according to the invention.

In the illustrated embodiment of the invention clips 30 attach to flange 20. FIG. 2 shows a clip 30 in greater detail. Clip 30 is formed from a strip of any suitable material, such as steel, strong plastic, or the like. The material of clip 30 is preferably resilient. Interior end 34 comprises one or more apertures 36 which can receive fasteners, such as screws or nails, to affix interior end 34 to building structure 10. Apertures 36 constitute one possible means for affixing interior end 34 to a building structure.

Figure 3:
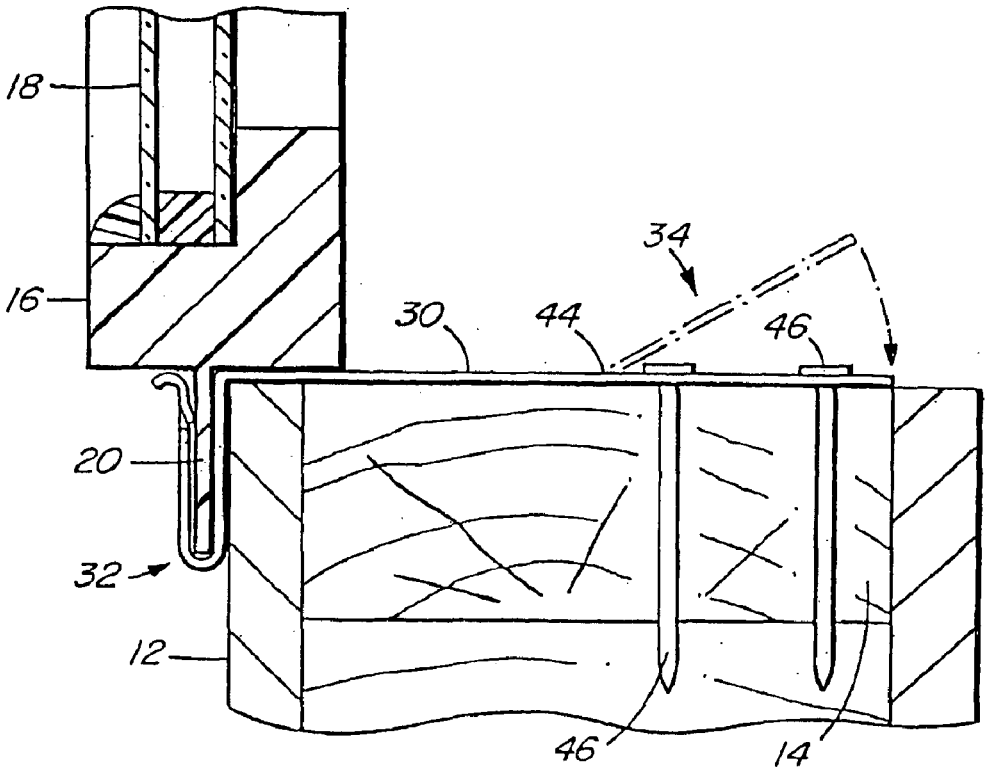
FIG. 3 is a cross section through a portion of a window installed in an aperture in a building frame with a window mounting clip according to the invention; and, FIGS. 4A, 4B and 4C are isometric views of end portions of window mounting clips according to alternative embodiments of the invention.

End 32 of clip 30 is bent to define a deep groove 38. As shown in FIG. 3, groove 38 is deep enough to receive flange 20 of window frame 16. The portions 39A and 39B of clip 30 on either side of groove 38 are preferably resiliently biased toward one another so that clip 30 tends to grip flange 20. Inwardly-angled teeth 40 may optionally be provided on one or both sides of groove 38. After flange 20 is received in groove 38, teeth 40 bite into flange 20 and resist any forces which might tend to pull flange 20 out of groove 38.

An outer side 42 of groove 38 is tapered so that it is easy to guide flange 20 into groove 38. As flange 20 is introduced into side 42 of groove 38, it tends to wedge portions 39A and 39B apart so that flange 20 is held securely in groove 38.

Clip 30 is preferably bent at a location intermediate ends 32 and 34. The bend defines a fulcrum 44. As shown in FIG. 3, when end 34 is fastened to structure 10, clip tends to pivot about fulcrum 44 so that end 32 is biased onto even firmer engagement with flange 20. Clip 30 is resiliently flexible. As end 34 is fastened to building structure 10 by fasteners, such as nails 46, clip 30 is straightened.

Providing a bend in clip 30 also facilitates affixing clip 30 to building structure 10 with fasteners (for example nails or screws) which are angled in an inward direction. When such fasteners are tightened, clips 30 are drawn inwardly and pull window frame 16 firmly into the aperture.

Figure 4A:
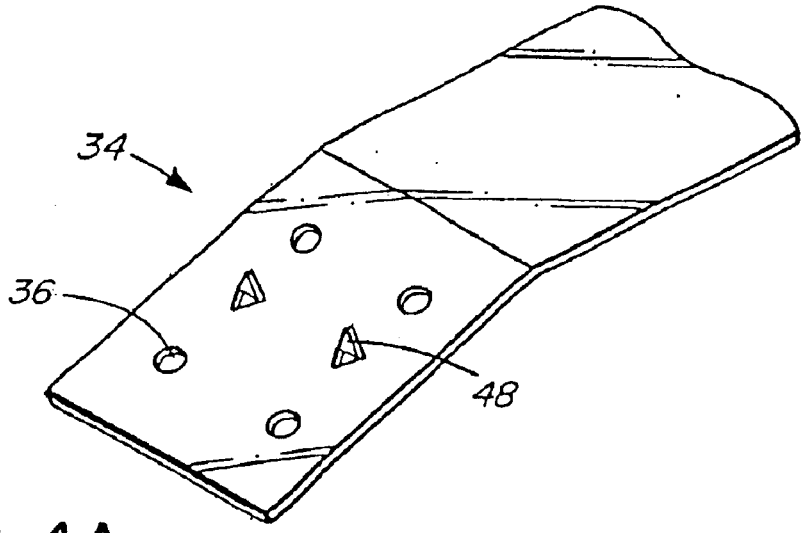
Figure 4B:
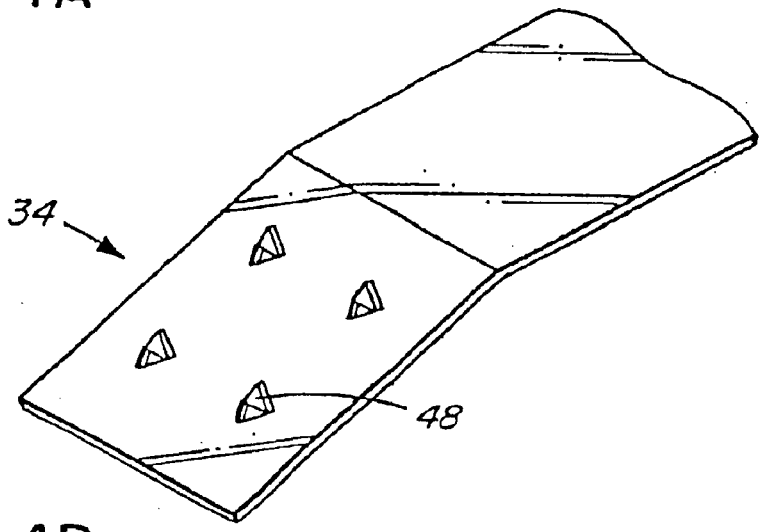
Figure 4C:
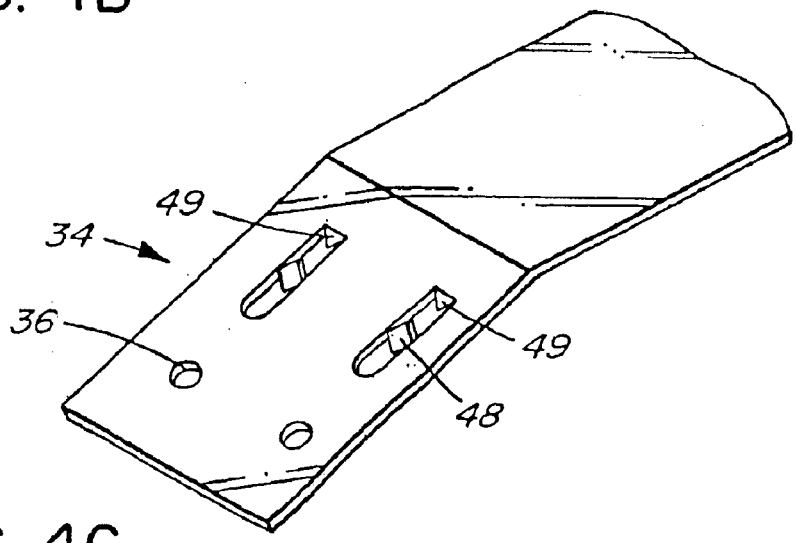

FIGS. 4A, 4B and 4C illustrate alternative configurations for interior end 34. In each of FIGS. 4A, 4B and 4C, end 34 includes a number of projections 48 which extend substantially laterally when clip 30 is affixed to a window frame 16. In the illustrated embodiments, projections 48 are integral with the material of the body of clip 30 and are formed by bending flaps of the material of clip 30. Projections 48 may be triangular, as shown in FIGS. 4A and 4B, rectangular, as shown in FIG. 4C, or otherwise shaped. The embodiments of FIGS. 4A and 4C comprise both apertures 36 and projections 48. In the alternative, projections 48 capable of use for affixing end 34 to building structure 10 could comprise separate elements affixed to end 34 in any suitable manner. For example, suitable projections 48 could be spot-welded to end 34. Projections affixed to end 34 provide an alternative means for affixing end 34 to a building structure 10.

In the embodiment of FIG. 4C, projections 48 are located near the ends of flexible fingers 49.

Projections 48 are not necessarily large enough to permanently affix ends 34 to a building structure 10. In some embodiments, projections 48 may be used to temporarily hold ends 34 to the building structure until screws or nails are inserted through apertures 36.

It can be appreciated that the use of this invention can significantly simplify the installation of prefabricated construction units in a building, especially where one would need a ladder, scaffold, man lift or the like to reach the locations where the construction units will be installed from the exterior of the building. A worker can affix clips 30 according to the invention to a construction unit and then, from inside the structure, orient the construction unit at an angle to the aperture in which the construction unit will be installed and pass the construction unit through the aperture to the outside of the structure. Still working from inside the structure, the worker can then draw the construction unit into place in the aperture and fasten the construction unit in place by affixing interior ends 34 of clips 30 to the structure. If necessary, shims may be installed around the frame of the construction unit to properly align the construction unit in the aperture.

A further advantage of the invention is realized in situations where a waterproofing membrane or the like is applied to the exterior of building frame 10. Prior art systems for securing construction units to building structures typically require the membrane to be punctured by nails or screws in the area adjacent to aperture 13. In some cases building codes prohibit fastening the lower sides of construction units in ways which result in the membrane being punctured. Sometimes windows are installed with no fasteners on their lower sides for this reason. The result can be that the lower sides of the windows can move, especially in windy weather. The use of clips 30 according to the invention allows the membrane to remain intact and still permits securing the lower side of window units and other construction units by way of one or more clips 30.

It can be appreciated that clips 30 having an exterior end 32 as described above can be affixed to a construction unit frame with minimal tools and without the need to drill holes in the frame or to modify the window or door frame in other respects.

Where a component (e.g. a member, tab, fastener etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example, while the above detailed description relates primarily to window units, it is to be understood that clips according to the invention may equally be used to secure other types of construction units, such as door units, vent units, sunlight units and the like, into appropriately sized apertures in a building frame. Accordingly, the scope of the invention is to be construed in accordance with the substance defined by the following claims.

What is claimed is:

1. A clip for use in affixing a construction unit within an aperture in a building structure, the construction unit having a frame and a flange projecting laterally from the frame exterior to the aperture, the clip comprising:

a thin tab for extending between the frame and a side of the opening in a direction at right angles to the flange and toward an interior of the building structure, the tab having a transverse substantially parallel-sided groove at an exterior end thereof for receiving the flange, the transverse groove oriented to support the tab at right angles to the flange, having a depth greater than a thickness of the tab, and having a mouth substantially in a plane of the tab; and one or more attachment points at an interior end of the tab, the one or more attachment points including one or more apertures, one or more projections, or one or more apertures and one or more projections.

2. A clip according to claim 1 wherein an opening of the groove is tapered.

3. A clip according to claim 1 comprising one or more inwardly-angled teeth within the groove.

4. A clip according to claim 3 wherein the groove and tab are integrally formed from a bent strip of a resilient material.

5. A clip according to claim 1 wherein the groove and tab are integrally formed from a bent strip of a resilient material.

6. A clip according to claim 1 comprising a fulcrum located between the groove and the one or more attachment points.

7. A clip according to claim 6 wherein the fulcrum comprises an outer surface of the tab at a location where there is a bend in the tab.

8. A clip according to claim 7 wherein the tab is fabricated of a resilient material.

9. A clip according to claim 8 wherein the resilient material is steel.

10. A clip according to claim 7 wherein an opening of the groove is tapered.

11. A clip according to claim 7 comprising one or more inwardly-angled teeth within the groove.

12. A clip according to claim 11 wherein the groove and tab are integrally formed from a bent strip of resilient material.

13. A clip according to claim 7 wherein the groove and tab are integrally formed from a bent strip of resilient material.

14. A clip for affixing a construction unit within an opening in a building structure, the clip comprising an exterior end and an interior end, the exterior end of the clip comprising means for affixing the clip to a flange of a construction unit, the flange extending laterally from the construction unit on an outside of a building structure the interior end of the clip comprising means for affixing the interior end of the clip to the building structure, the clip comprising a thin portion extending between its interior and exterior ends for passing through the opening beside the frame of the construction unit.

15. A construction unit comprising:

a frame;

a flange projecting laterally from the frame around a periphery of the frame in a plane of the frame; and, a plurality of tabs projecting from the frame in an interior direction, the tabs extending generally at right angles to the flange, each of the tabs having an exterior end attached to the flange and comprising one or more attachment points at an interior end thereof, the one or more attachment points including one or more apertures, one or more projections, or one or more apertures and one or more projections.

16. A construction unit according to claim 15 wherein each of the plurality of tabs has a fulcrum at a location intermediate its interior and exterior ends.

17. A construction unit according to claim 16 wherein the fulcrum comprises an outer surface of the tab at a location where there is a bend in the tab.

18. A construction unit according to claim 17 wherein the tab is fabricated of a resilient material.

19. A construction unit according to claim 18 wherein the resilient material is steel.

20. A construction unit according to claim 17 wherein the tab comprises a groove at its exterior end and the groove receives and grips the flange.

21. A construction unit according to claim 17 wherein the tab comprises one or more inwardly-angled teeth within the groove.

22. A construction unit according to claim 21 wherein the groove and tab are integrally formed from a bent strip of resilient material.

23. A construction unit according to claim 17 wherein the groove and tab are integrally formed from a bent strip of resilient material.

24. A construction unit according to claim 15 wherein the frame is four-sided and the construction unit comprises a plurality of tabs projecting from each of the four sides of the frame.

25. A construction unit according to claim 15 wherein the construction unit comprises a window unit having a transparent panel within the frame.

26. A construction unit according to claim 15 wherein the construction unit comprises a door unit having a door within the frame.

27. A construction unit according to claim 15 wherein the construction unit comprises a vent unit having a vent within the frame.

28. A construction unit according to claim 15 wherein the construction unit comprises a sunlight unit having a translucent panel within the frame.

29. A method for installing a construction unit in an aperture in a wall of a building structure, the construction unit comprising a frame having a flange projecting in a lateral direction around a periphery of the frame in a plane of the frame, the method comprising:

affixing a plurality of tabs to the flange with the tabs each projecting interiorly from the frame in a direction generally at a right angle to the flange;

placing the construction unit into the aperture with the flange against an outer surface of the building structure and the tabs extending from the flange, inwardly through the aperture beside the frame; and, affixing interior ends of the tabs to the building structure.

30. A method according to claim 29 wherein the construction unit comprises a number of sides and the method comprises affixing at least one of the tabs to each of the sides of the frame.

31. A method according to claim 30 comprising drawing the flange against an outer surface of the wall of the building structure.

32. A method according to claim 31 wherein affixing a plurality of tabs to the frame of the construction unit comprises affixing the plurality of tabs to the flange of the construction unit.

33. A method according to claim 32 wherein each of the plurality of tabs comprises a groove at an exterior end of the tab and affixing each of the plurality of tabs to the flange of the construction unit comprises forcing the flange of the construction unit into the groove of the tab.

34. A method according to claim 29 wherein each of the tabs is resilient and comprises a fulcrum point and the method comprises, either before or during affixing an interior end of the tabs to the building structure, resiliently flexing an interior end of the tab in a lateral direction and thereby biasing an exterior end of the tab against the frame.

35. A method according to claim 29 wherein affixing an interior end of one or more of the tabs to the building structure comprises driving a screw through an aperture in the interior end of the one or more of the tabs and into the building structure.

36. A method according to claim 29 wherein affixing an interior end of one or more of the tabs to the building structure comprises driving a nail through an aperture in the interior end of the one or more of the tabs and into the building structure.

37. A method according to claim 29 wherein one or more of the tabs comprises an integral substantially laterally-extending projection and affixing an interior end of one or more of the tabs to the building structure comprises driving the laterally-extending projection into the building structure.

* * * * *